US010393106B2

(12) United States Patent
Gillespie, III et al.

(10) Patent No.: US 10,393,106 B2
(45) Date of Patent: Aug. 27, 2019

(54) PUMPS, PUMP ASSEMBLIES, AND METHODS OF PUMPING FLUIDS

(71) Applicant: Sustainable Waste Power Systems, Inc., Kingston, NY (US)

(72) Inventors: Michael Joseph Gillespie, III, Shohola, PA (US); Christopher Paul Gillespie, Ridgefield, CT (US)

(73) Assignee: SUSTAINABLE WASTE POWER SYSTEMS, INC., Kingston, NY (US)

( * ) Notice: Subject to any disclaimer, the term of this patent is extended or adjusted under 35 U.S.C. 154(b) by 363 days.

(21) Appl. No.: 14/570,667

(22) Filed: Dec. 15, 2014

(65) Prior Publication Data

US 2016/0169219 A1 Jun. 16, 2016

(51) Int. Cl.

| | |
|---|---|
| ***F04B 15/02*** | (2006.01) |
| ***F04B 49/12*** | (2006.01) |
| ***F04B 53/14*** | (2006.01) |
| ***F04B 49/22*** | (2006.01) |
| ***F04B 53/10*** | (2006.01) |

(52) U.S. Cl.

CPC ..... *F04B 49/12* (2013.01); *F04B 15/02* (2013.01); *F04B 49/22* (2013.01); *F04B 53/10* (2013.01); *F04B 53/14* (2013.01)

(58) Field of Classification Search

USPC ..... 417/270, 437; 92/5 R, 13, 16, 54, 172; 137/565.13; 60/443, 450, 452

See application file for complete search history.

(56) References Cited

U.S. PATENT DOCUMENTS 4,087,209 A * 5/1978 Mahig ..... F04B 5/00 417/268
4,140,044 A * 2/1979 Biller ..... F16J 10/02 91/402
4,537,603 A * 8/1985 Firey ..... C10J 3/04 201/35
5,133,859 A * 7/1992 Frank ..... B01D 11/0203 203/49
5,478,439 A * 12/1995 De La Bruniere ..... D21C 1/00 162/17
5,748,077 A * 5/1998 Brandt ..... B60T 11/323 340/450

(Continued)

FOREIGN PATENT DOCUMENTS

EP 1011856 4/2003

*Primary Examiner* — Peter J Bertheaud
*Assistant Examiner* — Geoffrey S Lee
(74) *Attorney, Agent, or Firm* — Baker & Hostetler LLP

(57) ABSTRACT

The present disclosure relates to a system and method for pumping a feedstock slurry through a device. The system includes a pressure pump, a first sensor, a second sensor, a controller, and a control valve. The pressure pump includes a plunger configured to pressurize the slurry to a first pressure prior to the slurry entering the device. The first sensor is configured to sense a second pressure of the slurry entering the device. The second sensor is configured to sense the position of the plunger. The controller is configured to determine a change of position of the plunger based on the sensed position of the plunger and to control the movement of the plunger by setting a plunger mode based on the second pressure of the slurry and the change of position of the plunger. The control valve is configured to control the flow rate of the slurry through the device.

31 Claims, 11 Drawing Sheets

(56) References Cited

U.S. PATENT DOCUMENTS

| | | | | |
|---|---|---|---|---|
| 7,763,685 | B2 * | 7/2010 | Michielin | B01J 8/002 422/131 |
| 7,815,876 | B2 * | 10/2010 | Olson | C08B 15/00 123/66 |
| 8,690,977 | B2 | 4/2014 | Gillespie, III | |
| 9,029,481 | B2 * | 5/2015 | Nemoto | C08G 63/78 525/411 |
| 2005/0084386 | A1 | 4/2005 | Mori et al. | |
| 2007/0144955 | A1 | 6/2007 | Mann et al. | |
| 2007/0213481 | A1 * | 9/2007 | Michielin | B01J 8/002 526/88 |
| 2008/0193299 | A1 * | 8/2008 | Oglesby | F04B 15/02 417/53 |
| 2011/0023701 | A1 | 2/2011 | Thomas | |
| 2014/0296448 | A1 * | 10/2014 | Nemoto | C08G 63/78 525/411 |

* cited by examiner

PUMPS, PUMP ASSEMBLIES, AND METHODS OF PUMPING FLUIDS

TECHNICAL FIELD

The present disclosure relates to an apparatus and related methods for pumping solid and/or fluid materials.

BACKGROUND

Pumping systems are used to pump feedstock material into a variety of devices, including devolatilization reactors, gasifiers, and other slurry piping systems utilized for slurry transport, treatment, and/or processing. The feedstock may be non-uniform or inconsistent and may cause issues while pumping the feedstock into a device. Current methods for pumping feedstock material into typical devolatilization systems include the use of traditional fluid type pumps having a valve, such as auto check valves, flap valves, ball valves, or the like. While fluid-type pumps can push large volumes of feedstock material through the valve these pumps are not effective at pumping lower volumes of feedstock, which reduces pump efficiency. Additionally, valves used with these pumps may jam or become obstructed by debris during a backflow event. In order to alleviate such obstructions, the valve has to be removed or taken apart to clear away any caught debris. These limitations can make operation and maintenance expensive and complex.

Thus, an improved pumping system for pumping feedstock is desired to improve efficiency.

SUMMARY

One aspect of the present disclosure includes an apparatus for pumping slurry into a device. The apparatus includes a plunger, a first sensor, a second sensor, and a controller. The plunger is configured to pressurize the slurry to a first pressure prior to the slurry entering the device. The first sensor is configured to sense a second pressure of the slurry entering the device. The second sensor is configured to sense the position of the plunger. The controller is configured to determine a change of position of the plunger based on the sensed position of the plunger, and to control the movement of the plunger by setting a plunger mode based on the second pressure of the slurry and the change of position of the plunger.

Another aspect of the present disclosure includes a system for pumping slurring into a device. The system includes a pressure pump, a first sensor, a second sensor, a controller, and a control valve. The pressure pump includes a plunger configured to pressurize the slurry to a first pressure prior to the slurry entering the device. The first sensor is configured to sense a second pressure of the slurry entering the device. The second sensor is configured to sense the position of the plunger. The controller is configured to determine a change of position of the plunger based on the sensed position of the plunger and to control the movement of the plunger by setting a plunger mode based on the second pressure of the slurry and the change of position of the plunger. The control valve is configured to control the flow rate of the slurry through the device.

Another aspect of the present disclosure includes a method for pumping slurry through a device. The method includes the following steps: i.) pressurizing the slurry to a first pressure to provide a pressurized slurry using a plunger, ii.) flowing the pressurized slurry into the device, iii.) sensing a second pressure of the slurry entering the device, iv.) comparing the second pressure pressure of the slurry to a predetermined threshold, v.) sensing a change of position of the plunger, and vi.) setting a plunger mode based on the comparison of the second pressure of the slurry to the predetermined threshold and the change of position of the plunger. The method may further include the following steps: determining a desired flow rate of the slurry, and controlling the motion of the plunger based on the first pressure of the slurry, the second pressure of the slurry, and the desired flow rate of the slurry. The desired flow rate of slurry ranges from 0 to 5 gallons per minute.

DETAILED DESCRIPTION OF ILLUSTRATIVE EMBODIMENTS

The disclosure relates generally to a system and method for controlling the flow of a carbonaceous feedstock. The method includes pumping the feedstock into a devolatilization system, whereby the feedstock is heated and substantially pulverized. While the feedstock is being heated, the materials composing the feedstock, including entrained volatiles, are thermally converted into simple carbon constituents that may be used as synthetic natural gas after separation from the water and remaining devolatilized solid fraction, or be used in a gasification reactor to further convert the devolatilized solids and volatiles together into a product SynGas.

Figure 1:
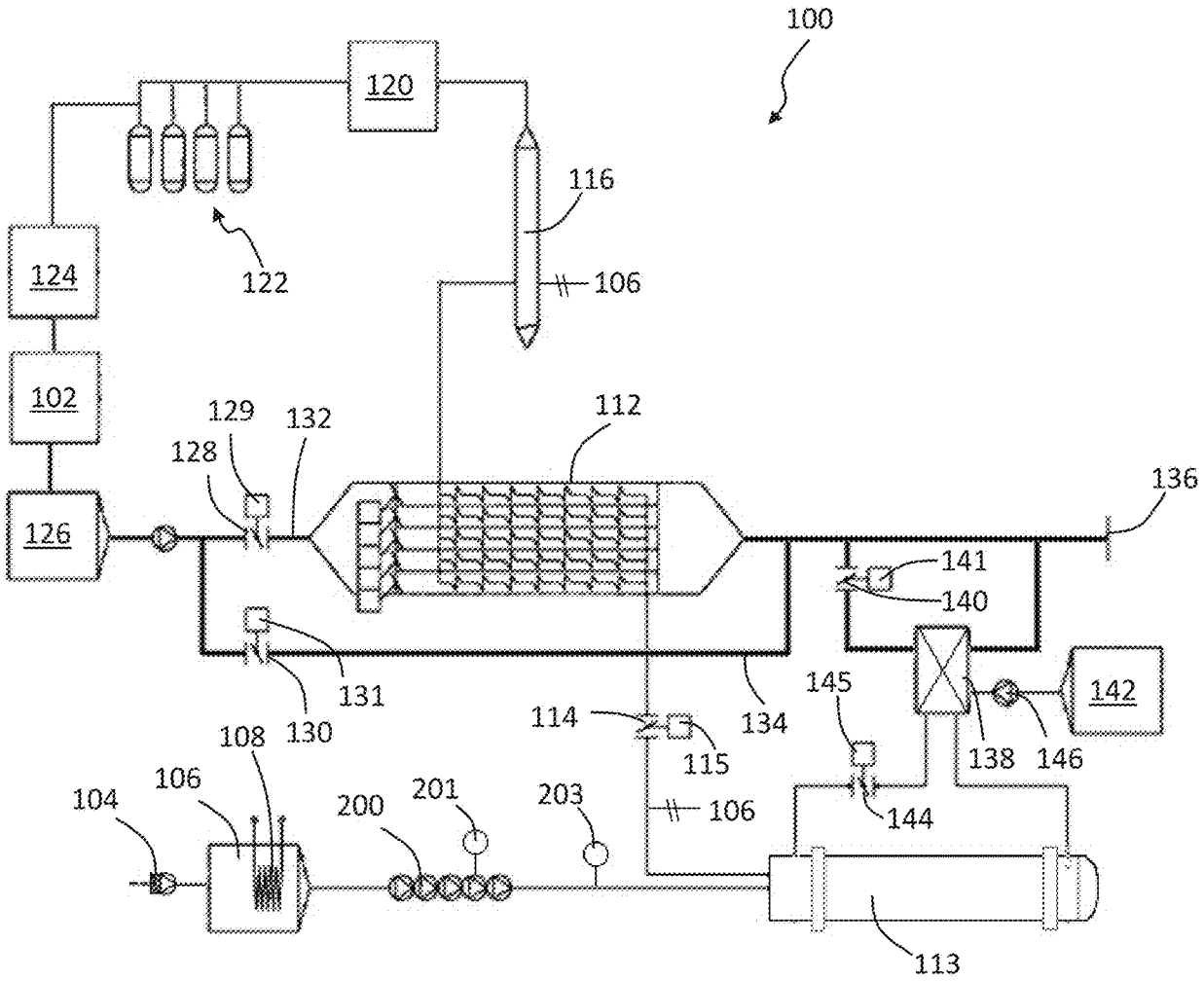
FIG. 1 illustrates a schematic of a devolatilization system, according to one aspect of the disclosure.

As used herein, the term "feedstock" generally means any carbon-bearing material that may be fed into a system for processing purposes. Feedstock may be in the form of municipal garbage and sewage and may include farm waste, food processing waste, etc. Feedstock can be sourced from any number of carbon-based materials. It should be appreciated that the output of one system may serve as the feedstock input material for another system, such as a gasifier 112 as illustrated in FIG. 1. Further, the devolatilization method may process any type of carbonaceous feedstock, utilizing similarly physically designed devolatilization systems for the carbonaceous feedstock. The systems may be modular and may be tuned in terms of capacity and reaction parameters.

FIG. 1 is a schematic of an embodiment of a power plant system 100 ("power plant") which comprises a pump assembly 200 for pumping feedstock through a reactor 113. The power plant 100 may utilize fuel cells as the primary energy generator 102. The power plant 100 may provide both power generation and waste disposal. In other embodiments, the power plant 100 may produce district natural gas and utilize the gas for mechanical power generation for use in a third party process. It should be appreciated that the power plant 100 may be arranged in a variety of configurations.

The feedstock may enter in through grinders 104, and be deposited in one or more holding tanks 106. The holding tank 106 may include tank heating coils 108, for preheating the feedstock prior to entering the devolatilization reactor 113. The power plant 100 may be configured to accept any combination of these feedstock streams.

It should be appreciated that there may be more than one grinder 104, and that the feedstock may flow through a series of grinders and pumps which grind the feedstock to a variety of dimensions. These may include fine grinder pumps, secondary grinder pumps, and other similar mechanisms. The feedstock may be ground to sizes as small as 0.005 inches or as large as 6 inches. This ground form of feedstock may be referred to as "feedstock slurry" or "slurry." Additionally, there may be more than one holding tank 106, whereby feedstock having varying properties may be stored separately.

After the feedstock is ground, the resulting slurry is stored in the one or more storage tanks 106. The pump assembly 200 may be used to pump the slurry into the devolatilization reactor 113. The flow rate of feedstock may be controlled by a control valve 114 by providing back-pressure to the reactor 113. The slurry is at a high pressure when delivered from the pump assembly 200. The assembly 200 may control the pressure within the reactor 113 by running a proportional-integral-derivative (PID) loop to control the motive air pressure through an electronic regulator (not shown). In an embodiment, the pressure exiting the pump 200 may be between 300 and 3,500 psia. It should be appreciated that the pressure pump may operate with an exit pressure range of 500 to 2,000 psia, and more preferably between 900 and 1,200 psia, as it enters the devolatilization reactor 113. It should be appreciated that the pressure at which the devolatilization reactor 113 operates may be such that the water in the slurry may flash to steam as it flows through the control valve 114. In an embodiment, the feedstock may comprise between 40% and 80% water.

The devolatilization reactor 113 may provide a first stage of feedstock thermal treatment. The feedstock may be treated at high pressure and medium temperature, between 300 and 600 degrees F. The reactor 113 may also treat the feedstock at temperatures between 400 and 500 degrees F., at a pressure just above the treatment temperature's steam saturation pressure. The feedstock may have a long residency time within the reactor 113, where the elevated temperatures and high pressure basically cook the material which releases simple gaseous constituents having simple hydrocarbons and other gaseous compounds and elements in a process known as devolatilization. Devolatilization entails the release of volatile constituents of the feedstock such as oxygen, and lighter and more easily released simple hydrocarbons.

In the illustrated embodiment, the feedstock slurry is pumped from the holding tanks 106 and into the devolatilization reactor 113. After the feedstock leaves the reactor 113, the feedstock slurry may be substantially converted to char slurry. Char includes more complex carbon based constituents in solid or liquid form substantially devoid of volatile materials that requires further processing to break down the final carbon bonds and produce synthetic natural gas. The feedstock may then flow through the control valve 114 and enter into the gasifier 112. It may also be returned to the holding tanks 106 along a feedstock recycle line, whereby it is recycled and further treated. Steam may be admitted to the feedstock from a steam header (not shown), prior to entering the gasifier 112.

The gasifier 112 performs a gasification process on the feedstock slurry. As the feedstock passes through the control valve 114, a portion of the water within the slurry will flash to steam. As it flashes, it becomes both a pulverizing force and a motive fluidizing agent which carries the feedstock through the gasifier 112. The steam is also a significant heat transfer medium between the feedstock and the gasifier heating medium. It is also a hydrogenating fluid, as the temperature at which the gasification occurs is within the region where the water-gas shift occurs.

Upon exit, the feedstock enters into a separator 116. The separator 116 may be of standard construction known in the field, and may feature a water bath at the base, where particulates such as ash are collected. The ash may be handled by an ash handling system (not shown). An ash handling system may include slurry pumps, separation tanks, grinder pumps, recycle circuits, transport circuits, and other components known in the art. The ash may be recycled along a recycle line and returned to the holding tanks 106 or it may be transported, for example, by a truck to a material recycler. It should be appreciated that in an alternative embodiment, that the power plant 100 may not include a gasifier and the devolatilization process ends after the feedstock exits the reactor 113, whereby it may directly enter the separator 116.

In the separator 116, the thermally converted synthetic natural gas is separated from any entrained ash or slag that is unwanted. To further separate the fine particles, the gas may exit the separator 116 and pass through a screen filter (not shown) and an aftercooler 120. The gas may be cooled and the condensate from the steam may be drained. The filters and aftercooler 120 may be of standard construction as known in the field.

The synthetic natural gas may leave the aftercooler and be routed to gas storage tanks 122, an auxiliary boiler 124, the primary energy generator 102, or combinations thereof. The gas may also be routed to other applications that may require natural gas, such as a booster heater.

The primary energy generator 102 may be a molten carbonate fuel cell (MCFC), a reciprocating engine, gas turbine, boiler, or other commercially available energy generation source. The primary energy generator 102 converts the natural gas into electricity and also produces heat to drive the remainder of this process. The heat produced by the energy generator 102 may be provided to the gasifier heating medium or fluid stored in a gasifier heating medium storage tank 126. In alternate embodiments, the gasifier heating fluid may be heated using coils prior to entering the storage tank 126, by burners upon exiting the storage tank 126, or combinations thereof.

The gasifier heating fluid may be pumped into the gasifier 112 through a gasifier heating fluid control valve 128 along a main path 132 and/or pumped along a bypass 134 through a bypass control valve 130. The bypass 134 rejoins the main path 132 after the gasifier heating fluid flows through the gasifier 112, whereby the heating fluid is exhausted 136 from the system 100. The heating fluid may also be diverted to a reactor heating medium generator 138, through a coil control valve 140, which is used to provide heat to a reactor heating medium used to provide heat to the devolatilization reactor 113. The reactor heating medium may be stored in a storage tank 142. The reactor heating medium may be pumped into the reactor 113 by a pressure pump 146 and may be regulated by a reactor heating fluid control valve 144. In alternate embodiments, prior to the heating fluid being exhausted, it may be admitted to a heat recovery steam generator, hot water generator, or other heat recovery apparatus known in the art. The reactor heating medium is preferably a heating oil, which has been previously heated by any one or combination of sources.

Figure 2:
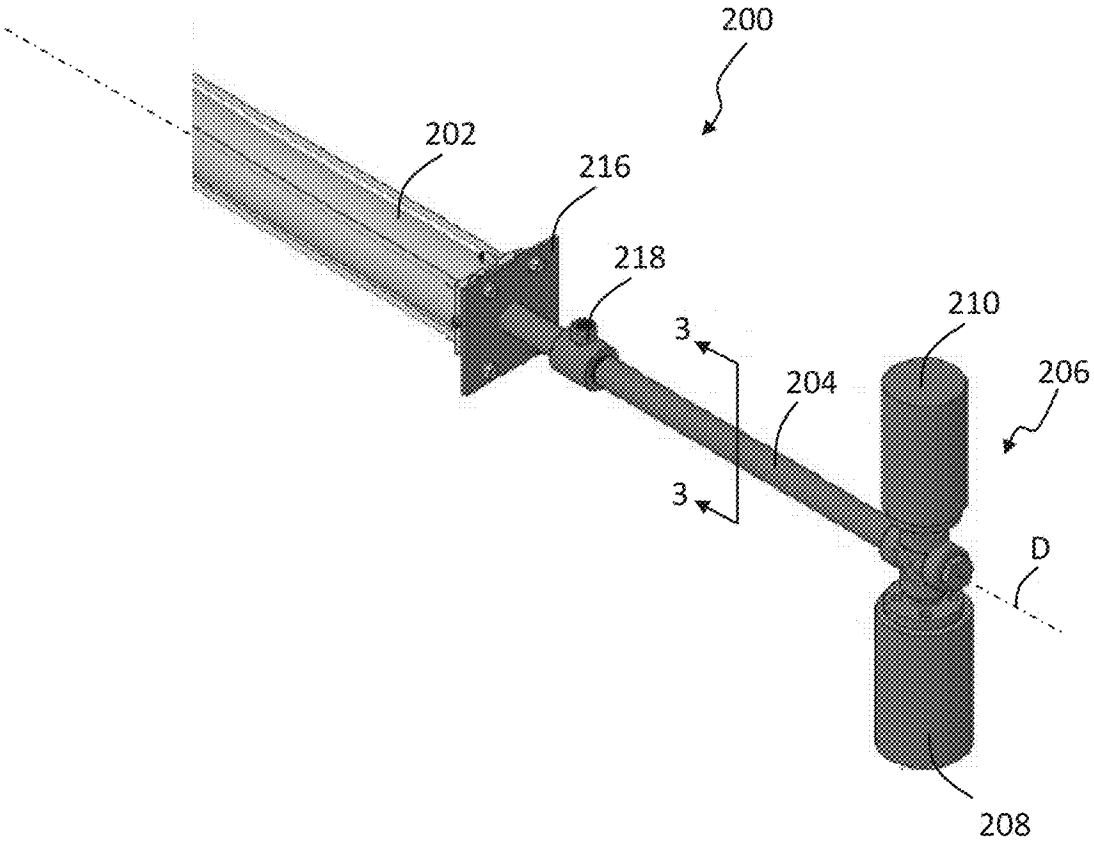
FIG. 2 is a perspective view of a pump assembly, according to one aspect of the disclosure.
Figure 3:
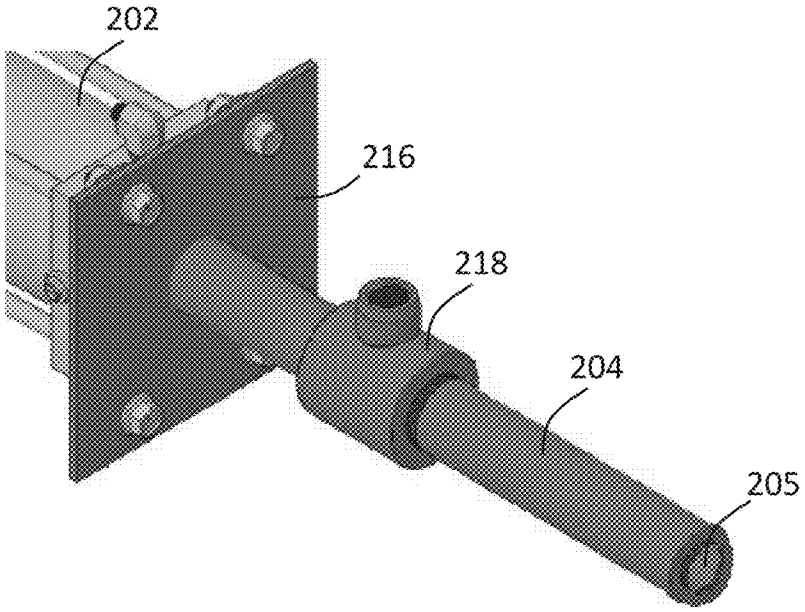
FIG. 3 is a perspective view of a cross sectional view of the pump assembly shown in FIG. 2 taken along line 3-3, according to one aspect of the disclosure.
Figure 4:
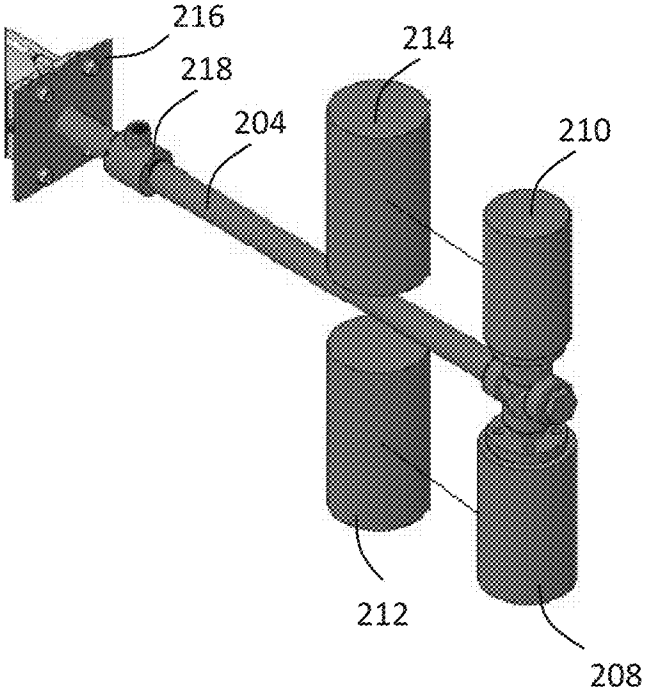
FIG. 4 is another perspective view of a pump assembly, according to an aspect of the disclosure.

FIGS. 2, 3, and 4 illustrate the pump assembly 200 according to an embodiment of this disclosure. The pump assembly 200 includes a pumping cylinder 202, a pump body 204, and a valve system 206. The pumping cylinder 202 may be coupled to an end of the pump body 204, and the pump body 204 may be coupled to the valve system 206. In an embodiment, the pumping assembly 200 may be a positive displacement pump.

The pump body 204 of the assembly 200 may define a body internal cavity configured to allow a plunger rod 205 to axially slide within the body cavity along axis D. The plunger rod may be operatively coupled to the cylinder 202 and configured to pressurize the feedstock slurry. The cylinder 202 may provide a driving force onto the plunger rod, moving the plunger rod in a reciprocating motion in an axial direction along axis D within the pump body cavity during a pumping operation. The plunger rod may have a first side and a second side, whereby the second side is in contact with the slurry. The cavity may further be configured to contain feedstock slurry being pumped into the reactor 113. The axis D may define an axial direction that extends along the center of the pump assembly 200 from the cylinder 202, through the pump body 204, and to the valve system 206.

The pump cylinder 202 may define a cylinder internal cavity and include a piston (not shown) and a fluid (not shown). The piston may be configured to axially slide within the internal cavity of the cylinder along the D axis. The piston may have a first side and a second side. The first side of the cylinder may be in contact with the fluid and the second side may be operatively connected to the first side of the plunger rod. The motion of the piston may be based on a change in pressure of the fluid, for example, an increase or decrease in pressure of the fluid. An increase in pressure may cause the fluid to expand and cause the piston to exert a compression force onto the plunger rod, and a decrease in pressure may cause the fluid to exert a suction force onto the plunger rod. It should be appreciated that the cylinder 202 may be a pneumatic cylinder and the fluid may be a hydraulic fluid.

The valve system 206 includes a suction valve 208, a discharge valve 210, a suction valve actuator 212, and a discharge valve actuator 214. The suction valve 208 and the discharge valve 210 may be coupled to an opposing end of the pump body 204 in which the cylinder 202 is coupled. The suction valve 208 may be operatively coupled to the plunger rod. The suction valve 208 may be configured to accept feedstock slurry from the one or more holding tanks 106. The suction valve 208 may include an open position and a close position, whereby in an open position, the plunger rod may provide a suction pressure on the feedstock forcing it through the suction valve 208 and into the cavity defined by the pump body 204. In a close position, the feedstock from the holding tanks 106 is restricted from flowing through the valve 208. It should be appreciated that the suction pressure provided to the feedstock may be provided by the suction force by the piston onto the plunger rod.

The discharge valve 210 may be fluidly coupled to the plunger rod and configured to admit slurry into the devolatilization reactor 113. The discharge valve 210 may include an open position and a close position, whereby in an open position, the plunger rod may provide a discharge pressure on the feedstock within the cavity forcing it through the discharge valve 210 and into the reactor 113. In a close position, the feedstock within the cavity is restricted from flowing through the discharge valve 210. It should be appreciated that the discharge pressure may be provided by the compression force exerted on the plunger rod by the piston.

The pump assembly 200 further includes a plunger seal 216. The plunger seal 216 may be coupled to the pump body 204 by a body coupling 218 and may be coupled to the pump cylinder 202 by bolts, welding, or other means used in the art. The plunger seal 216 may define an opening configured to allow a portion of the plunger rod to slide through. The plunger seal 216 is further configured to indicate a failure and to reduce the pressure of the slurry within the pump body 204 when the pressure within the pump body 204 exceeds a certain pressure threshold. In an embodiment, the pressure threshold may be defined by a pressure differential between the pressure exiting the pump body 204 through the discharge valve 210 and the pressure within the pump body 204. The pressure differential may also be referred to as a safety threshold. In an embodiment, the safety threshold may be 100 psi.

The pump assembly 200 may further include a safety mechanism (not shown) configured to bar the suction valve 208 from opening if the discharge valve 210 cannot close. The safety mechanism may be further configured to inhibit the discharge valve 120 from opening or closing immediately upon an indication of a failure by the plunger seal 216. It should be appreciated that the safety mechanism may include an electromechanical linkage, a software lock, or other mechanism used to bar a valve from opening or closing.

Figure 5:
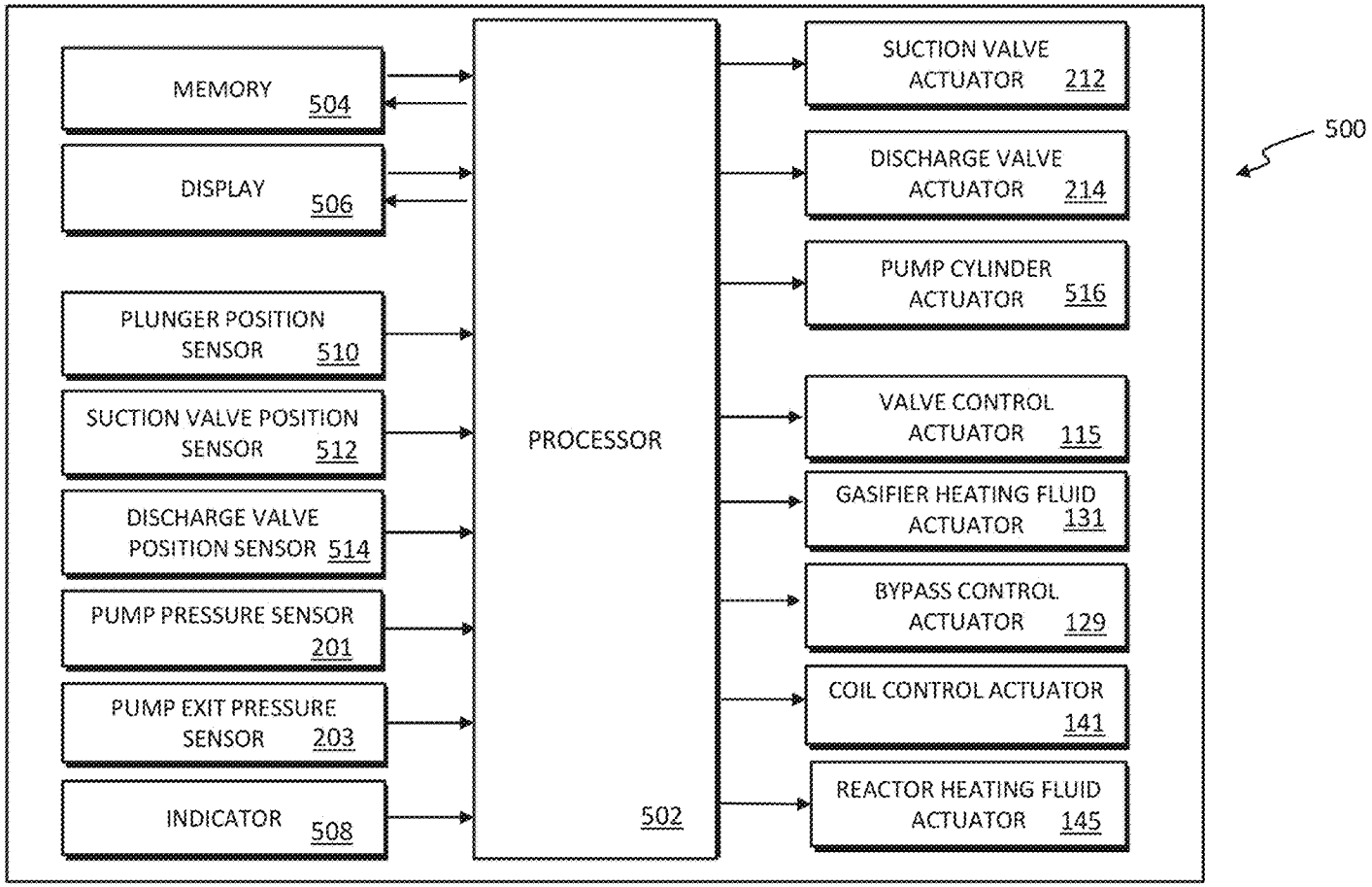
FIG. 5 is a schematic of a controller used to control a pump assembly, according to one aspect of the disclosure.

To facilitate control and coordination of the pump assembly 200, the pump assembly 200 may include a controller 500, as illustrated in FIG. 5. While the controller 500 illustrated in FIG. 5 is represented as a single unit, in other aspects the controller 500 may be distributed as a plurality of distinct but interoperating units, incorporated into another component, or located at a different locations on or off the pump assembly 200 within the power plant system 100. FIG. 5 illustrates a block diagram of an embodiment of the components that may comprise the controller 500. The controller 500 may include a pump pressure sensor 201, a pump exit pressure sensor 203, a plunger position sensor 510, a suction valve position sensor 512, a discharge valve position sensor 514, a suction valve actuator 212, a discharge valve actuator 214, a pump cylinder actuator 516, a processor 502, a memory 504, a display or output 506 and an indicator 508. In an embodiment, the controller 500 may also include a valve control actuator 115, a gasifier heating fluid actuator 129, a bypass control actuator 131, a coil control actuator 141, and a reactor heating fluid actuator 145 coupled to the reactor control valve 114, gasifier heating fluid control valve 128, bypass valve 130, coil control valve 140, and reactor heating fluid control valve 144, respectively. It should be appreciated that in other embodiments, additional actuators, sensors, or gauges may be used, for example, to sense and control the pressure and temperature of the feedstock within the pump assembly 200, the reactor 113, or the gasifier 112.

The pump pressure sensor 201 may be configured to sense a parameter indicative of the pressure of the slurry inside the pump body 204 and the pump exit pressure sensor 203 may be configured to sense a parameter indicative of the pressure of the slurry as it exits the pump body 204 through the discharge valve 210. The sensors 201 and 203 may include signal transducers configured to sense a transmitted signal, or a component of a transmitted signal. The plunger position sensor 510 may sense a parameter indicative of the position of the plunger rod within the pump body 204. The suction valve sensor 512 and the discharge valve sensor 514 may sense parameters indicative of the position of the suction valve 208 and the position of the discharge valve 210, respectively. The indicator 508 may be configured to sense a parameter indicative of a failure, such as, for example, a plunger seal 216 failure. In an embodiment, each of the sensed parameters may be provided to the processor 502. The processor 502 may be configured to output signals that are responsive to inputs from each sensor 201, 203, 508, 510, 512, and 514 as further described herein. The display 506 may be coupled with the processor 502 and may display various data to an operator relating to the slurry pressure, position of the plunger rod, and positions of the suction valve 208 and the discharge valve 210, or still other parameters. Action may be taken in response to the display data or other pump assembly metrics to coordinate and control the pump assembly 200.

The memory 504 may be a computer readable memory and may include random access memory (RAM) and/or read-only memory (ROM). The memory 504 may store computer executable code including a control algorithm for controlling the pump assembly 200 responsive to inputs from each sensor. The memory 504 may also store various digital files including the values sensed by the pump pressure sensor 201, the pump exit pressure sensor 203, the plunger position sensor 510, the suction valve sensor 512, or the discharge valve sensor 514. The information stored in the memory 504 may be provided to the processor 502 so that the processor may coordinate control.

The display 506 may be located either on the pump assembly 200, located remotely, or may include multiple displays both on the pump assembly 200 and remotely, and may include, but not limited to, cathode ray tubes (CRT), light-emitting diode display (LED), liquid crystal display (LCD), organic light-emitting diode display (OLED) or a plasma display panel (PDP). Such displays can also be a touchscreen and may incorporate aspects of an input device (not shown).

The processor 502 may be configured to provide signals to the suction valve actuator 212, the discharge valve actuator 214, and the pump cylinder actuator 516. The signals provided to the suction valve actuator 212 and the discharge valve actuator 214 may be indicative of a position of each valve 208 and 210, respectively, such as an open position or a close position. Thus, each actuator 212 and 214 may control each valve 208 and 210 to a specific position. In an embodiment, the controller 500 may be configured such that neither the suction valve 208 nor the discharge valve 210 are controlled to the open position at the same time, and neither the suction valve 208 nor the control valve 210 is controlled to the closed position at the same time. The signal/s provided to the pump cylinder 202 may include a desired pressure value of the fluid within. By providing a pressure value to the fluid, the motion of the piston, and therefore, the motion of the plunger rod, may be controlled. For example, a signal indicative of an increase in pressure may provide a force onto the plunger rod which may pressurize the slurry within the pump body 204 resulting in the slurry flowing through the discharge valve 210. A signal indicative of a decrease in pressure may provide a force onto the plunger rod that may provide a suction force onto the slurry resulting in the slurry flowing through the suction valve 208 and into the pump body 204.

In an embodiment, the controller 500 may include a control algorithm for controlling the flow of slurry through the pump assembly 200. The control algorithm may include the following parameters: a pressure of the slurry within the pump body 204 sensed by the pump pressure sensor 201, a pressure of the slurry as it exits the pump body 204 sensed by the pump exit pressure sensor 203, and a change of position of the plunger rod. The change of position of the plunger rod may be determined by the processor 502 based on the parameter indicative of the plunger position sensed by the plunger position sensor 510. Based on these parameters the controller 500 may control the flow of the slurry by controlling the motion of the plunger rod, the position of the suction valve 208, and the position of the discharge valve 210.

The motion of the plunger rod may include two modes, however, it should be appreciated that various modes may be used during operation of the pump assembly 200. The first mode, or steady mode, involves a continuous or complete movement of the plunger rod. The plunger rod may include two motions, a stroke (or compression) motion, and a load (or suction) motion. In the steady mode, the continuous movement of the plunger rod transitions between the stroke motion and the load motion unceasingly, such that at the end of a stroke motion, a load motion begins approximately immediately. Additionally, the continuous movement may include both a full stroke motion and a full load motion. A full stroke motion may include fully extending the plunger rod such that a minimum amount of slurry remains in the pump body 204. A full load motion may include a plunger position which allows a maximum amount of slurry into the pump body 204.

The second mode, or clearing mode, of the plunger rod may involve an uneven movement of the plunger rod. The uneven movement may include a partial stroke motion and a partial load motion. The partial stroke motion may be defined as any stroke motion less than the full stroke motion and the partial load motion may be defined as any load motion less than the full load motion. The transition between the partial stroke motion and the partial load motion may be continuous; however, the time between each stroke motion of the plunger in the clearing mode is substantially shorter than the time between each stroke motion in the steady mode. Additionally, when in the clearing mode, the distance the plunger travels during each stroke is substantially shorter than the distance the plunger travels during each stroke when controlled to the steady mode.

The controller 500 may set the plunger rod to the clearing mode when the pressure of slurry exiting the pump body 204 is greater than a predetermined pressure threshold for a predetermined amount of time, and there is substantially no change of position of the plunger. The predetermined pressure threshold and the predetermined amount of time may be established based on physical characteristics of the pump assembly 200, or the device which is receiving the pressurized slurry from the pump assembly 200, such as the devolatilization reactor 113, or other components that may be integrated into the power plant system 100. The predetermined pressure threshold and the predetermined amount of time may also be established based on other characteristics, such as, for example, the consistency or density of the slurry. The plunger rod may be set to the clearing mode for between 0 and 5 seconds. It should be appreciated that in other embodiments, if the slurry exiting the pump body 204 is greater than the predetermined threshold for a predetermined amount of time and there is no substantial change of position of the plunger, the controller 500 may be configured to shut down the pump assembly 200, whereby the suction valve 208 and the discharge valve 210 may be controlled to the close position and the plunger rod may be controlled to cease motion.

The suction valve 208 and the discharge valve 210 may be controlled by the controller 500 to specific positions when the plunger rod is in the steady mode or the clearing mode. In the steady mode, the suction valve 208 and the discharge valve 210 are configured to move between the open position and the close position successively. During the load motion of the plunger, the suction valve 208 may be in the open position while the discharge valve 210 is in the close position. During the stroke motion of the plunger, the suction valve 208 may be in the close position and the discharge valve 210 may be in the open position. As the plunger rod transitions between the load and stroke motions, the valves 208 and 210 switch between their respective positions accordingly. In the clearing mode, the suction valve 208 may be set to the close position while the discharge valve may be set to the open position. These positions may be unchanged while the plunger rod transitions between the load and stroke motions.

In an embodiment, the power plant system 100 may include more than one pump assemblies 200 configured to pump feedstock slurry. The at least one other pump assembly may be configured substantially similarly to the pump assembly 200, whereby a pressurized slurry is provided to the devolatilization reactor 113. The controller 500 may be further configured to control the more than one other pump assembly to provide a continuous or constant flow of slurry into the reactor 113.

The controller 500 may also be configured to control the plunger rod to clear debris or other buildup that may accumulate in either the suction valve 208 or the discharge valve 210 during operation of the pump assembly 200. The controller 500 may determine whether to clear debris based on information provided by the suction valve position sensor 512 and the discharge valve position sensor 514. If the sensed position of either valve 208 or 210 is inconsistent with a controlled position of the valve 208 or 210, whereby the sensed position is determined to be open and the valve 208 or 210 was controlled to be in the close position, or vice versa, then the controller 500 may control the valve 208 or 210 to move between the open position and the close position in rapid succession. In an embodiment, the debris clearing process may be performed while the plunger is set to the clearing mode.

FIGS. 6A through 6D illustrate a schematic for a method 600 of pumping slurry using the pumping assembly 200, according to one aspect of this disclosure. At step 602, the controller 500 determines whether the plunger is ready to load (e.g. begin steady mode). This determination may depend on certain factors, for instance, when the power plant 100 includes more than one pumping assembly 200, each pumping assembly 200 must wait for each other pumping assembly 200 to complete their respective load stroke and release the pump assembly 200. If the pump assembly 200 is not ready to load, it waits for release before loading (604). At step 606, after the controller 500 determines the plunger is ready to load, the controller 500 starts the load by sending a signal, via the processor 502, to the pump cylinder actuator 516 indicating a decrease in pressure of the fluid within the pump cylinder 502. The decrease in pressure of the fluid may cause the plunger rod to begin the load motion. Once the load motion has started, the initial jog parameters are set (607). As used herein, the term "jog" or "jogging" may refer to the movement of a component, such as the piston, plunger, suction valve 208, or discharge valve 210, in a rapid succession. At step 608, prior to completion of the load, the suction valve position sensor 512 may send a signal to the controller 500 indicating the position of the suction valve 208. If the suction valve 208 is in the close position, then a suction valve failure (610) may exist which may result in a system shutdown. If the suction valve 208 is in the open position the plunger continues with the loading motion (612). During the loading motion (612), slurry may be admitted into the pump body 204. At step 614, the position of the plunger rod is determined. If the plunger rod has completed a full load motion (616), then the controller 500 will set initial jog parameters (618). If the plunger rod has not completed a full load motion, at step 620, the controller 500 may determine whether a loss of travel has occurred. A loss of travel may exist when a load motion has not completed and there is substantially no change of position of the plunger rod. If a loss of travel has occurred, then the pump assembly 200 may be jogged (622). The jogging process may include controlling the pump assembly 200 to the clearing mode. If a loss of travel has not occurred than the loading motion continues until completion.

At step 624, the controller 500 determines whether the suction valve 208 has closed following the loading stroke. If the valve 208 has not closed, then at step 626, the controller 500 may jog the suction valve 208. Jogging the suction valve 208 may include controlling the suction valve 208 to and from the open and close positions. This may be performed in rapid succession to clear any debris which may be restricting the suction valve 208 from closing. Jogging the suction valve 208 may also include the plunger rod being set to the clearing mode. After the suction valve 208 has closed, the pump assembly 200 is released (628).

At step 630, the controller 500 determines whether the pump assembly 200 is ready to start a stroke motion. The stroke motion may pressurize the slurry within the pump body 202 and facilitate flow through the discharge valve 210 and into the devolatilization reactor 113. If the pump assembly 200 is not ready to stroke, the assembly 200 waits for release (632). After release, the assembly 200 begins to stroke (634). The stroke motion may be produced by the controller 500 sending a signal, via the processor 502, to the pump cylinder actuator 516 indicating an increase in pressure of the fluid within the pump cylinder 502. The increase in pressure of the fluid may cause the plunger rod to begin the stroke motion. At step 636, the controller 500 compares the pressure of the slurry within the pump body 202 to the pressure of the slurry exiting the plunger body 202. If the pressures do not match, then a seal failure (638) may exist and the controller 500 may shut down the pump assembly 200. If the pressures do match, then at step 640, the controller 500 determines whether the discharge valve 210 is in the open position based on an indication from the discharge valve sensor 514. If the discharge valve 210 is not in the open position, then a discharge valve failure (642) may exist and the pump assembly 200 may be shut down. If the discharge valve 210 is in the open position, the plunger continues with the stroking motion (644). During the stroking motion (644), slurry may be admitted into the devolatilization reactor 113. At step 646, the position of the plunger rod is determined. If the plunger rod has completed a full stroke 648, then the controller 500 will set initial jog parameters (650). If the plunger rod has not completed a full stroke motion, at step 652, the controller 500 may determine whether a loss of travel has occurred. A loss of travel may exist when the stroke motion has not completed and there is substantially no change of position of the plunger rod. If a loss of travel has occurred, then pump assembly 200 may be jogged (622). If a loss of failure has not occurred than the stroking motion continues until completion.

At step 656, the controller determines whether the discharge valve 210 has closed following the stroking motion. If the valve 210 has not closed, then at step 658, the controller 500 may jog the discharge valve 210. Jogging the discharge valve 210 may include controlling the discharge valve 210 to and from the open and close positions. This may be performed in rapid succession to clear any debris which may be restricting the discharge valve 210 from closing. Jogging the discharge valve 210 may also include the plunger rod being set to the clearing mode. After the discharge valve 210 has closed, the pump assembly 200 is released (660) and the method of operation completes.

Figure 6A:
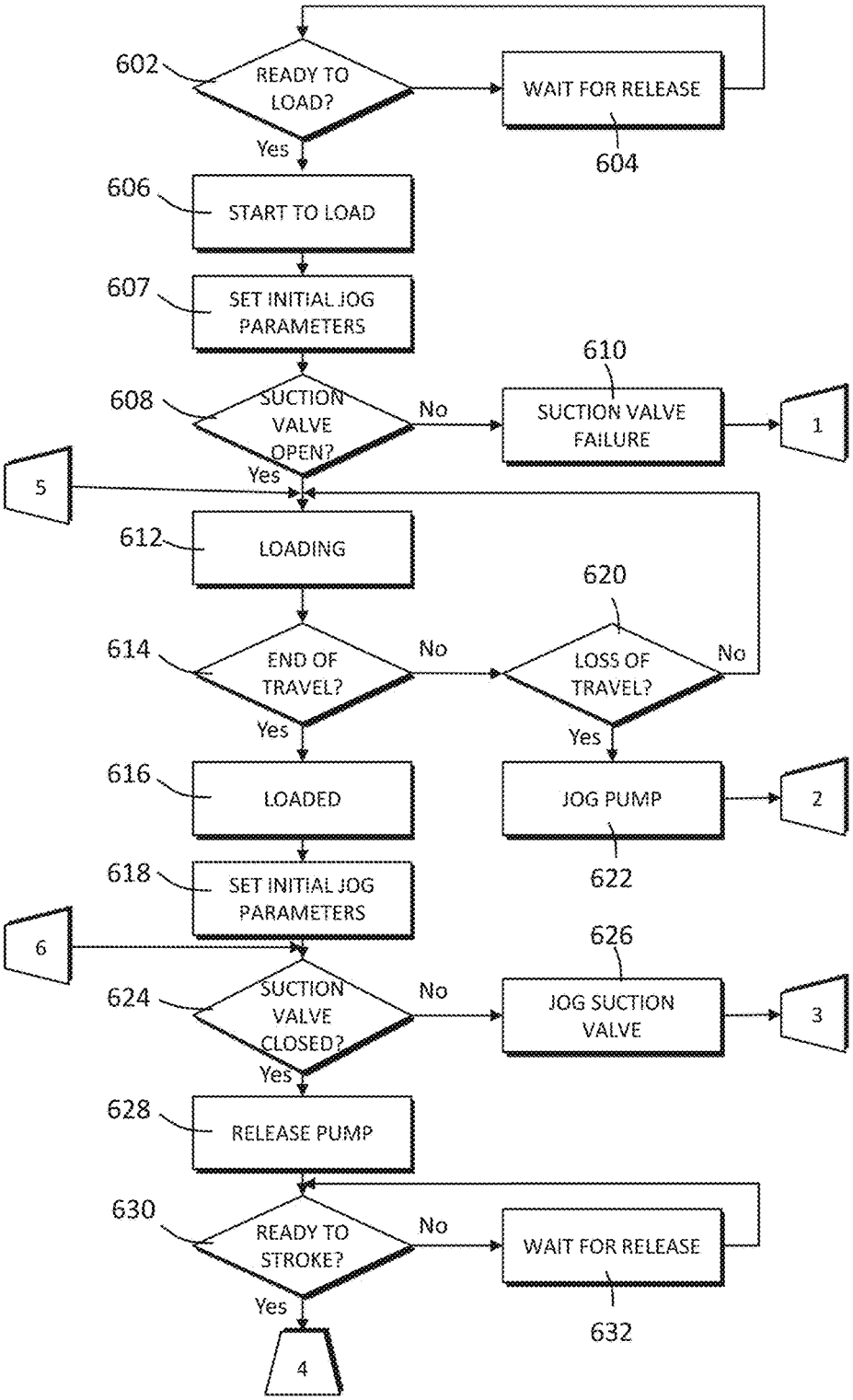
FIG. 6A is a flow diagram of a method of operating a pump assembly, according to one aspect of this disclosure.
Figure 6B:
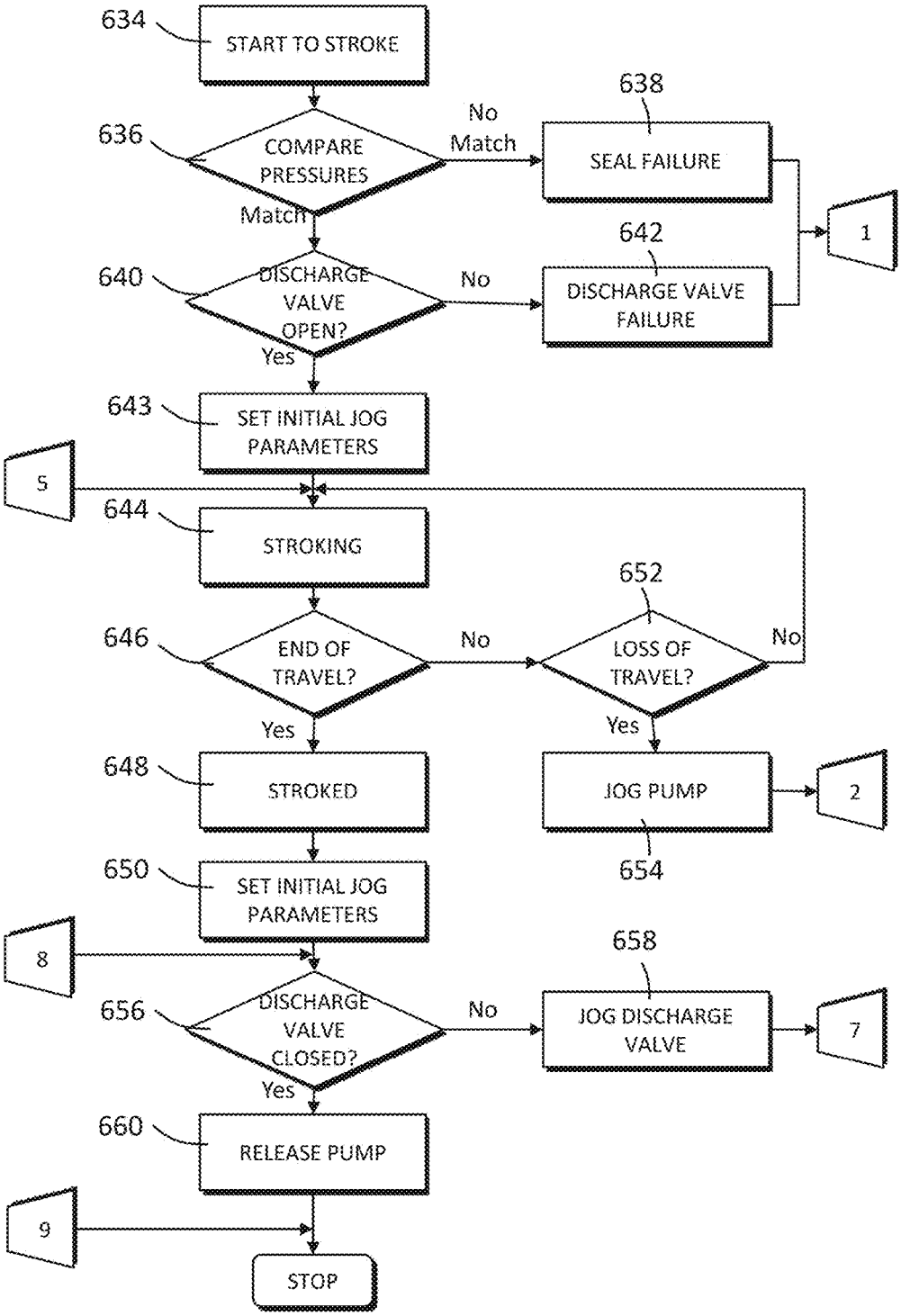
FIG. 6B is a continuation of the flow diagram of FIG. 6A, according to one aspect of this disclosure.
Figure 6C:
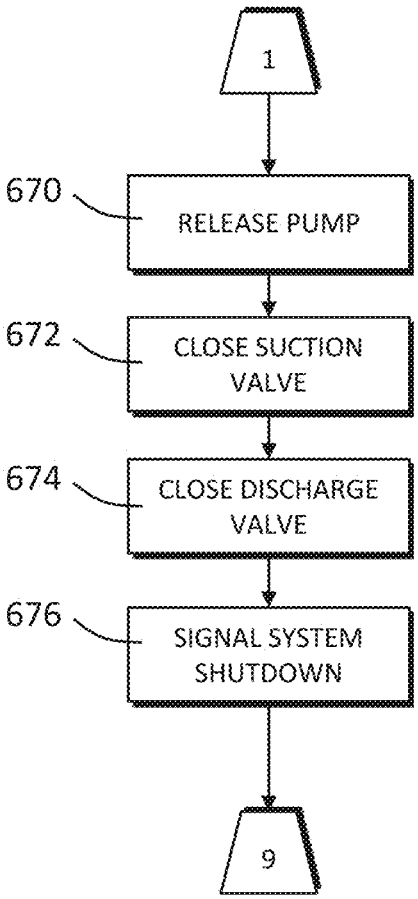
FIG. 6C is a flow diagram of a method for shutting down a pump assembly, according to one aspect of this disclosure.

FIG. 6C illustrates a flow process for shutting down the pump assembly 200 upon a detected failure. If a failure has been detected, such as a suction valve failure (610 or 692), seal failure (638), discharge valve failure (642 or 702), or plunger rod loss of travel failure (682), then a pump assembly 200 shut-down may occur. During system shut-down, the pump assembly 200 may be released (670), the suction valve 208 and the discharge valve 210 may be closed (672 and 674), and the system shutdown may be signaled (676), completing the pump operation.

Figure 6D:
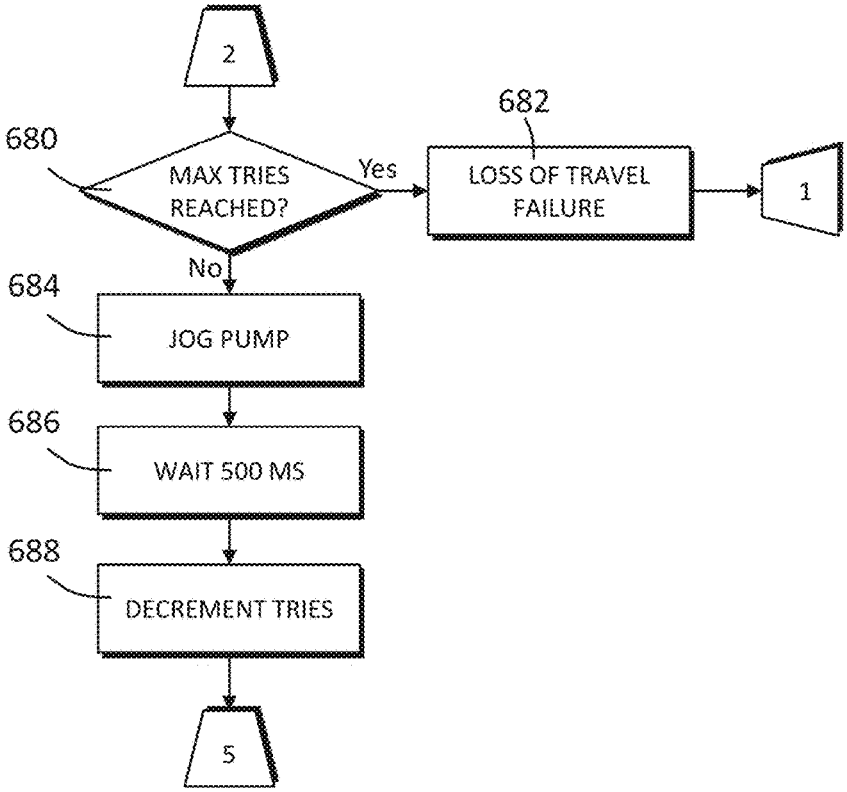
FIG. 6D is a flow diagram of a method for jogging a pump assembly, according to one aspect of this disclosure.

FIG. 6D illustrates a flow process for a plunger rod loss of travel jogging process. If a loss of travel is detected (620 or 652), then the pump assembly 200 may be jogged (622 or 654). There may be a maximum number of times the pump assembly 200 may try to jog the plunger. This may be input by an operator or set during manufacture of the pump assembly 200 and stored in memory 504. If the maximum number of tries has not been reached, then the pump assembly 200 may be jogged (684). After the jog, the controller 500 may wait 500 ms (686) and decrement the number of tries (688). If the maximum number of tries is reached (680), then a valve failure (682) may occur and the pump assembly 200 may be shut down.

Figure 6E:
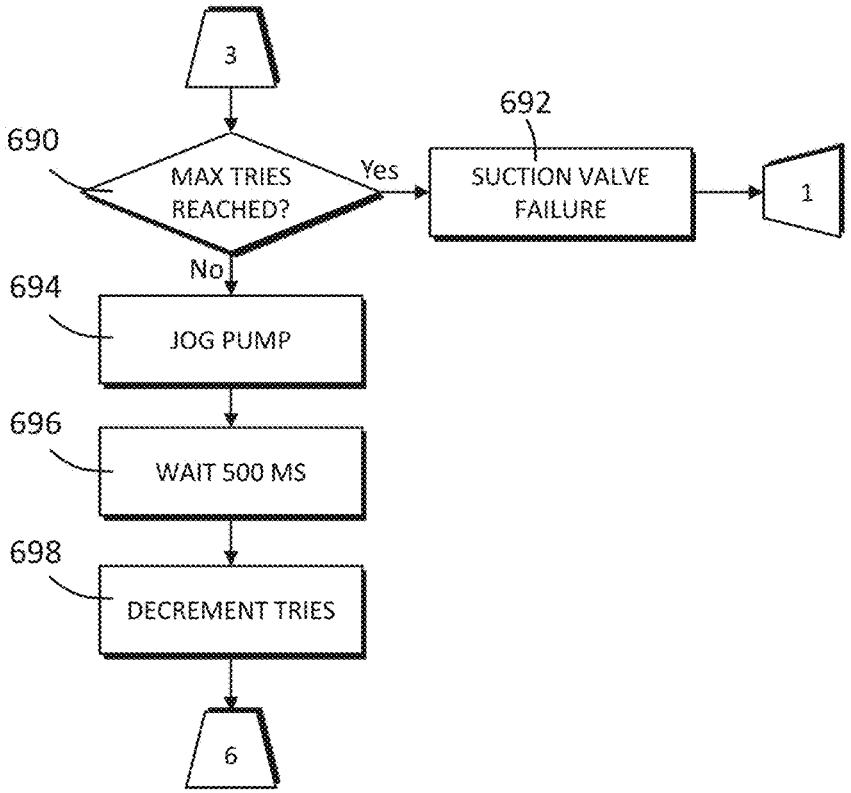
FIG. 6E is a flow diagram of a method for jogging a suction valve, according to one aspect of this disclosure.
Figure 6F:
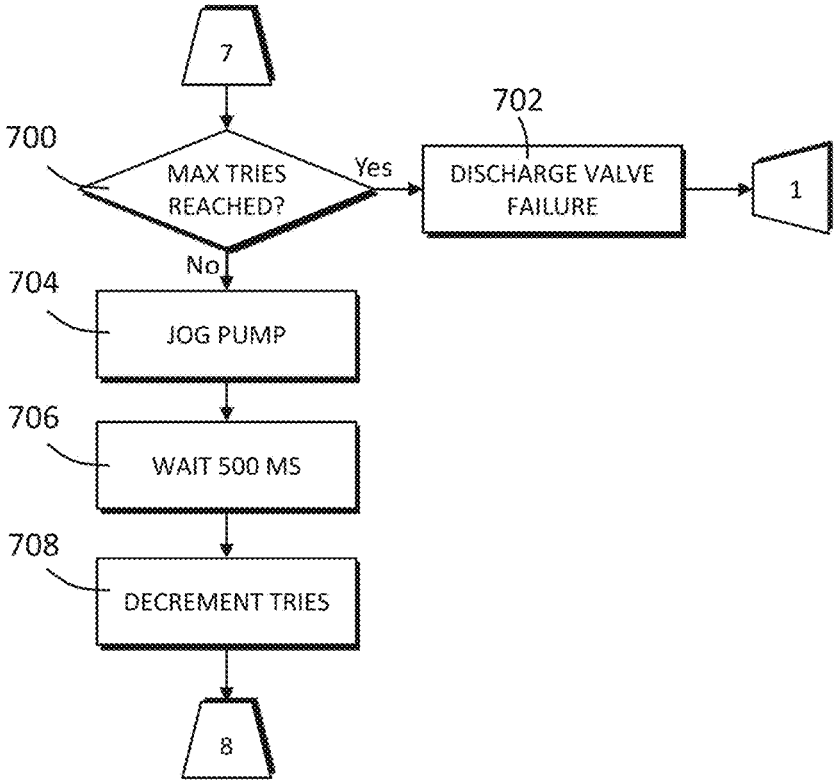
FIG. 6F is a flow diagram of a method for jogging a discharge valve, according to one aspect of this disclosure.

FIGS. 6E and 6F illustrate a jogging process for when the suction valve 208 and the discharge valve 210 do not close following their respective loading and stroking motions. There may be a maximum number of times (690 and 700) the pump assembly 200 may try to jog either the suction valve 208 or the discharge valve 210. If the maximum number of tries has not been reached, then the pump assembly 200 may be jogged (694 or 704) as described herein. After the jog, the controller 500 may wait 500 ms (696 or 706) and decrement the number of tries (698 or 708). If the maximum number of tries is reached (690 or 700), then a suction valve failure (692) or a discharge valve failure (702) may occur and the pump assembly 200 may be shut down.

While the disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. An apparatus configured to pump a slurry into a device, the apparatus comprising: a pump body; a plunger positioned within the pump body, the plunger configured to pressurize the slurry to an initial pressure within the pump body; a pressure sensor configured to sense a pressure of the slurry at an exit of the pump body; a position sensor configured to sense the position of the plunger; and a controller configured to 1) determine a change of position of the plunger based on the sensed position of the plunger, and 2) transition the plunger between a steady mode and a clearing mode based on the pressure of the slurry sensed by the pressure sensor at the exit of the pump body and the change of position of the plunger sensed by the position sensor, wherein in the steady mode the plunger travels between a stroke motion and a load motion unceasingly, such that at the end of the stroke motion, the load motion begins immediately, and wherein in the clearing mode the plunger travels between a stroke clearing motion and a load clearing motion, wherein in the clearing mode the plunger travels a first distance between stroke motions and in the steady mode the plunger travels a second distance between stroke motions, wherein the first distance is shorter than the second distance.

2. The apparatus of claim 1, wherein the controller transitions to the clearing mode when the pressure of the slurry at the exit of the apparatus is greater than a predetermined pressure threshold for a predetermined amount of time, wherein the predetermined pressure threshold and the predetermined amount of time are based on a consistency of the slurry.

3. The apparatus of claim 2, wherein when the plunger is set to the steady mode the plunger is capable of moving in a continuous motion.

4. The apparatus of claim 2, further comprising:

a discharge valve fluidly coupled to the plunger and configured to admit the slurry into the device, wherein the controller is further configured to control the discharge valve to an open position and a close position, wherein when the plunger is set to the steady mode the discharge valve is controlled between the open position and the close position, and wherein when the plunger is set to the clearing mode the discharge valve is controlled to the open position.

5. The apparatus of claim 4, further comprising: the pump body defining a body internal cavity, wherein the pump body includes the plunger configured to axially slide within, the plunger having a first side and a second side, wherein the second side of the plunger is in contact with the slurry; and a pump cylinder having a cylinder internal cavity, wherein the pump cylinder includes a piston and a fluid, wherein the piston is configured to axially slide within the cylinder internal cavity, and wherein the piston has a first side and a second side, wherein the first side is in contact with the fluid and the second side is operatively in contact with the first side of the plunger, wherein a change in pressure of the fluid moves the piston within the cylinder internal cavity which moves the plunger within the body internal cavity providing the initial pressure to the slurry.

6. The apparatus of claim 4, wherein the pump body and the pump cylinder are coupled together.

7. The apparatus of claim 4, wherein the pump cylinder is a pneumatic cylinder.

8. The apparatus of claim 7, wherein the controller is further configured to control the discharge valve and the suction valve such that neither the discharge valve or the suction valve are in an open position at the same time as the other and that neither the discharge valve or the suction valve are in a close position at the same time as the other.

9. The apparatus of claim 8, further comprising:

a safety mechanism configured to bar the suction valve from opening if the discharge valve cannot close, wherein the safety mechanism is further configured to inhibit the discharge valve from opening or closing immediately upon an indication of a plunger seal failure.

10. The apparatus of claim 7, further comprising:

a plunger seal coupled to the pump body, the plunger seal defining an opening configured to allow a portion of the plunger to slide therethrough, wherein the plunger seal is configured to indicate a failure and to reduce the initial pressure of the slurry when the initial pressure of the slurry exceeds the pressure of the slurry at the exit of the apparatus by a safety threshold.

11. The apparatus of claim 10, wherein the safety threshold is 100 psi.

12. The apparatus of claim 4, further comprising:

a suction valve fluidly coupled to the plunger and configured to admit the slurry into the pump body, wherein the controller is configured to control the suction valve to an open position and a close position, wherein when the plunger is set to the steady mode the suction valve is controlled between the open position and the close position, and wherein when the plunger is set to the clearing mode the suction valve is controlled to the close position.

13. The apparatus of claim 4, wherein the discharge valve is positioned external to the pump body, such that slurry flows through the discharge valve after exiting the pump body.

14. The apparatus of claim 1, wherein the device is a devolatilization reactor.

15. The apparatus of claim 1, wherein the controller is further configured to transition the plunger to the clearing mode when the position sensor senses no change of position of the plunger.

16. A system for pumping a slurry into a device comprising: a pressure pump having a plunger configured to pressurize the slurry to an initial pressure within the pressure pump; a pressure sensor configured to sense a pressure of the slurry at an exit of the pressure pump; a position sensor configured to sense the position of the plunger; a controller configured to determine a change of position of the plunger based on the sensed position of the plunger, and further configured to control the movement of the plunger by setting a plunger mode based on the pressure of the slurry sensed by the pressure sensor at the exit of the pressure pump and the change of position of the plunger sensed by the position sensor, wherein the plunger mode includes a steady mode and a clearing mode, wherein in the clearing mode the distance the plunger travels between consecutive strokes is shorter than the distance the plunger travels between consecutive strokes in the steady mode, and wherein in the steady mode the plunger travels between a stroke motion and a load motion unceasingly, such that at the end of the stroke motion, the load motion begins immediately; and a control valve configured to control the flow rate of the slurry through the device.

17. The system of claim 16, wherein the initial pressure is applied to the feedstock during a hydraulic lock.

18. The system of claim 16, wherein the pressure pump is a first pressure pump, wherein the initial pressure is a first initial pressure, wherein the pressure sensor is a first pressure sensor, wherein the pressure of the slurry within the device is a first pressure, and wherein the position sensor is a first position sensor, the system further comprising:

a second pressure pump having a second plunger configured to provide a second initial pressure to the slurry within the second pressure pump;

a second pressure sensor configured to sense a second pressure of the slurry at the exit of the second pressure pump; and a second position sensor configured to sense the position of the second plunger, wherein the controller is further configured to determine a change of position of the second plunger based on the sensed position of the second plunger, and further configured to control the movement of the second plunger by setting a second plunger mode based on the second pressure of the slurry at the exit of the second pressure pump and the change of position of the second plunger.

19. The system of claim 18, wherein the controller is further configured to control the movement of the second plunger to provide a continuous flow of slurry into the device.

20. A method for pumping a slurry through a device, comprising: pressurizing, using a plunger positioned within a pump body, the slurry to an initial pressure to provide a pressurized slurry; flowing the pressurized slurry into the device; sensing a pressure of the slurry at an exit of the pump body; comparing the pressure of the slurry sensed at the exit of the pump body to a predetermined threshold; sensing a change of position of the plunger; and setting a plunger mode based on the comparison of the pressure of the slurry within the device to the predetermined threshold and the change of position of the plunger sensed by the position sensor, wherein the plunger mode includes a steady mode and a clearing mode, wherein in the steady mode the plunger travels between a stroke motion and a load motion unceasingly, such that at the end of the stroke motion, the load motion begins immediately, and wherein in the clearing mode the distance the plunger travels between consecutive stroke clearing motions is shorter than the distance the plunger travels between consecutive stroke motions in the steady mode.

21. The method of claim 20, wherein an amount of time the plunger mode is set to the clearing mode is between 0 and 5 seconds.

22. The method of claim 20, wherein the plunger mode is set to the clearing mode when the pressure of the slurry at the exit of the apparatus is greater than a predetermined pressure threshold for a predetermined amount of time, wherein the predetermined pressure threshold and the predetermined amount of time are based on a consistency of the slurry.

23. The method of claim 20, wherein the slurry flows through a valve prior to entering the device, and wherein the valve has an open position and a close position, wherein in the open position slurry can flow through the valve and in the close position slurry is restricted from flowing through the valve, wherein the method further comprises:

controlling the valve to a first position;

sensing a second position of the valve;

comparing the first position of the valve to the second position of the valve; and setting the plunger mode based on the comparison of the first position of the valve to the second position of the valve.

24. The method of claim 23, wherein the plunger is set to the clearing mode when the first position of the valve is different from the second position of the valve.

25. The method of claim 24, wherein when the plunger is set to the clearing mode the method further comprises:

controlling the valve to the open position and the close position in rapid succession.

26. The method of claim 23, wherein the valve is a discharge valve.

27. The method of claim 23, wherein the valve is a suction valve.

28. The method of claim 20, further comprising:

determining a desired flow rate of the slurry; and controlling the motion of the plunger based on the initial pressure of the slurry, the pressure of the slurry at the exit of the apparatus, and the desired flow rate of the slurry.

29. The method of claim 28, wherein the desired flow rate of slurry ranges from 0 to 5 gallons per minute.

30. The method of claim 20, wherein the direction and speed of movement of the plunger is adjusted by an incompressible fluid.

31. The method of claim 20, wherein the pressure of the slurry at the exit of the apparatus ranges from 300 psi to 3,500 psi.

* * * * *